US005480258A

United States Patent [19]

Allen

[11] Patent Number: 5,480,258

[45] Date of Patent: Jan. 2, 1996

[54] VARIABLE WIDTH, TWIN ENGINE RIDING TROWEL

[75] Inventor: J. Dewayne Allen, Paragould, Ark.

[73] Assignee: Allen Engineering, Inc., Paragould, Ark.

[21] Appl. No.: 176,118

[22] Filed: Dec. 30, 1993

[51] Int. Cl.[6] ..... E01C 19/00; E01C 19/22

[52] U.S. Cl. ..... 404/112

[58] Field of Search ..... 404/96, 97, 112

[56] References Cited

U.S. PATENT DOCUMENTS

| | | | |
|---|---|---|---|
| D. 323,510 | 1/1992 | Allen | D15/10 |
| 3,936,212 | 2/1976 | Holz | 404/112 |
| 4,046,483 | 9/1977 | Sutherland | 404/112 |
| 4,046,484 | 9/1977 | Holz | 404/112 |
| 4,775,306 | 10/1988 | Kikuchi et al. | 404/112 X |
| 5,108,220 | 4/1992 | Allen | 404/112 |

*Primary Examiner*—William P. Neuder
*Attorney, Agent, or Firm*—Stephen D. Carver; Trent C. Keisling

[57] ABSTRACT

A self-propelled, dual motor, variable width riding trowel for finishing a concrete surface. The riding trowel comprises a frame mounting a seat for an operator and controls accessible by the operator for steering and controlling the trowel. Adjustable subframe blocks mount a pair of motors, each driving a bladed rotor for frictionally contacting the concrete surface and supporting the frame. Displaceable gearboxes, pivotally mounted to the subframe, transfer rotation from each motor to its rotor. The motors are interlinked by an extensible driveshaft extending between the gearboxes that synchronizes the rotors. Lever arms disposed beneath the frame tilt the gearboxes and rotors in response to the controls for steering the trowel. An extensible guard cage, mounted to the frame, prevents inadvertent contact between the rotors and foreign objects. The trowel may be expanded to receive finishing pans on the blades of the rotors. Expansion of the trowel requires displacement of several components. Each motor and gearbox is mounted to a sliding block mated to frame rails which slidably couple the blocks to the frame. The controls comprise a replaceable torque shaft having a length dependent on the distance between the axes of the rotor-gearbox assemblies.

22 Claims, 11 Drawing Sheets

VARIABLE WIDTH, TWIN ENGINE RIDING TROWEL

BACKGROUND OF THE INVENTION

1. Field of the Invention

The present invention relates generally to motorized concrete finishing machines. More particularly, the present invention relates to high powered riding trowels that can be varied in width to accept various finishing implements. Representative self propelled riding trowels are classified in United States Patent Class 404, Subclass 112.

2. Description of the Prior Art

As will be recognized by those skilled in the art, freshly placed concrete must be appropriately finished. Motorized trowels have proven to be effective for finishing the surface of wet concrete. There are two major types of motorized trowels, including manually manipulated trowels and larger riding trowels. Each type of trowel employs finishing blades that rest directly upon and frictionally contact the concrete surface to be finished. Hence, the blades support the machine's entire weight.

The trowel is passed over the concrete surface several times as the concrete sets. The pitch of the blades is adjustable. To vary pitch, each trowel blade may be pivoted about its longitudinal axis. Modern practice calls for the use of rotating finishing pans during initial machine finishing to achieve "super-flat" and "super-smooth" floors. A wide variety of manually pushed troweling machines, or power trowels have previously been proposed. However, self propelled riding trowels can finish concrete quicker and more efficiently over larger areas than manual trowels.

Prior art riding trowels generally include some form of frame from which two or more bladed rotors project downwardly. An operator sits atop the frame and controls movement of the trowel through a steering system. The rotors are driven by a self contained motor mounted on the frame, which may be linked to rotor gearboxes. Steering is accomplished by tilting the axis of rotation of the rotors. A yoke controlled bearing assembly is often employed to vary blade pitch. The weight of the trowel and the operator is transmitted frictionally to the concrete by the revolving blades.

Riding trowels typical of those present in the art are disclosed in two patents issued to Holz, U.S. Pat. Nos. 4,046,484 and 3,936,212. '212 is a three rotor riding trowel while '484 is a more popular two rotor trowel. Each of the rotors in the Holz patents has three radially spaced apart blades.

I have been involved with several prior motorized trowel inventions. U.S. Pat. No. 5,108,220 relates to a fast steering system for riding trowels. It discloses a state of the art steering system for riding trowels that enhances maneuverability and control. U.S. Pat. Des. 323,510 also discloses a riding trowel.

Most current, popular riding trowels incorporate two sets of bladed rotors. The sweeps of the rotors overlap to provide a smooth finished surface without an intermediate seam. It is also known in the art to provide a disc-shaped finishing pan device in place of the blades to flatten freshly placed concrete. The advent of more stringent concrete surface finish specifications using "F" numbers to specify flatness (ff) and levelness (fl), dictate the use of pans on a widespread basis. Pan finishing allows surface finishing to proceed sooner after initial placement of the concrete. The larger surface area of the pan lowers bearing pressure. This allows wet concrete to be worked earlier and provides a hydraulic effect upon the concrete monolith. As concrete cures, the interior is in a semi-fluid state compared to the surface. In other words, the surface tends to cure earlier than the interior of the monolith. The pans force the high points downwardly, providing a leveling effect at the surface that improves overall (fl) smoothness. Since the concrete surface can be worked earlier, grout is easily and quickly brought to the surface. The grout can be quickly moved into low points and fill voids, and the pans level the surface to a superior flatness.

The process of working the surface of freshly placed concrete by pan finishing has been established by practiced and experienced builders, skilled in the art. Modern panning of concrete floor surfaces is essential to economically achieve a "super-flat" floor. In practice, the trowel is panned across the slab, then turned to repeat the circuit, advancing about one pan width each pass. This procedure fills voids, works down high points and provides a "super-flat" floor surface finish. Generally, the pans are rotated relatively slowly, at fifty to eighty RPM.

Trowel pans are rotated like bladed rotors. However, the pan normally must have a smaller diameter than rotors, since pans cannot overlap, and must not contact one another. Therefore, the pan covers a reduced area in contrast to the bladed rotor. To overcome this disadvantage and to make full use of trowel engine output, a riding trowel with wider spacing for relatively larger pan drive elements is suggested.

Typically pan finishing is followed by blade finishing. In the final stage of finishing, the trowel blades are adjusted to a relatively high pitch angle and operate at high speed- one hundred-fifty RPM or more. This provides a smooth, slick surface. The prior art suggests the use of two finishing trowels to timely finish a floor before curing.

It is economically disadvantageous with known trowels to first mount pans and then replace them with blades during finishing. With fixed frame trowels, pans that can be retrofitted are too small. Further, horsepower demands upon trowels incorporating large blades or pans are extreme. When large areas are to be troweled, time constraints are important. If for example, a pan-equipped machine is too slow, the concrete in remote slab areas will harden without proper pan finishing. Surface uniformity will suffer, even if subsequently blade-trowelled. Pans affect machine handling. They can make an otherwise versatile machine difficult and cumbersome to handle. Relatively higher horsepower is needed to enable self-propelled, panning trowels to properly steer, even when running relatively slow. However, added horsepower must be properly distributed to the unit, and the steering mechanism must handle the pressure. Hence, it is desirous to provide a power riding trowel that can mount either pans or blades. The machine must be easily convertible at the job site during the finishing of a floor. As a result, a single machine is used to pan finish and blade finish a floor before curing. The cage and drive centers of the trowel must be adjustable outwardly to mount the pans. Critical steering linkages must also adapt.

SUMMARY OF THE INVENTION

My Variable Width, Twin Engine Riding Trowel allows an operator to selectively mount pans or blades on a single machine. My trowel may be converted on the job site quickly enough to allow a single machine to both pan and blade finish a floor. The axes of rotation of the machine's rotors are moved apart to fit the pans directly onto the blades.

The cage and steering system of my trowel are adapted to accommodate this expansion. Importantly, the entire system is adapted for twin engines, to distribute the higher horsepower that is, in the best mode, necessary for the invention.

My trowel comprises a metal frame mounting a pair of displaceable motors. Each motor drives a bladed rotor. The rotors counter-rotate and are synchronized. A guard cage mounted to the frame prevents inadvertent contact between the rotors and foreign objects. An operator sits in a seat mounted to the frame and steers the rotors with a pair of primary control levers, which tilt the rotors to generate steering forces. The longitudinal pitch of the blades on each rotor is also controlled by the operator. Other controls available to the operator include a throttle pedal and engine switches. Illumination may be provide by lights mounted on the frame.

Each motor is mounted to a generally parallelepiped sliding block. The block is slidably mounted on a pair of rails. The rails are mounted to a pair of brackets extending from the frame. Allen screws threaded through the blocks engage flats in the rails to hold the blocks in place. Each motor drives a gearbox driven via pulleys and fan belts. A splined driveshaft extends between the input shafts of the gearboxes to synchronize the rotors. U-joints on each end of the driveshaft facilitate independent movement of the gearboxes. The gearboxes are mounted to tiltable, pivotable steering boxes secured to the sliding blocks. A rotor is secured to a shaft extending downwardly from each gearbox. Therefore, each motor, gearbox and rotor move together with the block.

The pitch of the blades of each rotor is varied by a tubular handle assembly or electric linear actuator. The handle or actuator is connected to a cable extending to a pivoting fork which contacts and actuates a swash plate. Arms extending from each rotor blade are deflected by the swash plate, varying the blade's pitch.

The steering system preferably comprises a pair of parallel lever arms extending beneath the frame. The forward ends of the arms are connected to the control levers. The rear ends are pivotally anchored to inclined struts extending from the rear of the frame. The mid portion of each arm is connected to an elongated torque rod. The torque rods are coupled to the gearboxes and tilt the rotors to provide steering. To facilitate expansion of the trowel, the torque rods are extensible. One rotor tilts forwardly and rearwardly as well as from side to side. A tertiary linkage connected to one of the control levers tilts this rotor. A support brace for a pivot point of the tertiary linkage is bolted to a slotted frame bracket, allowing it to be displaced during expansion and contraction of the trowel. Also, a torque shaft in the tertiary linkage must be replaced when the width of the trowel is altered.

The pans used to provide a super-flat finish to the concrete surface are generally disc shaped, and they have an upturned circumference. Tabs on the inner surface of the pans define narrow offsets adapted to wedgably receive a finishing blade, so that the pans are quick mounted to the trowel.

The guard cage is expandable. It comprises a lower oval ring and reinforcement guard bars above the lower ring. Spokes extend between the ring and bars. End spokes are received by frame bosses and are held in place by allen screws. Separable flanges at the front and rear of the cage are bolted together whenever the trowel cage is narrowed. Spacers are inserted between the flanges when the trowel is expanded. The guard cage preferably includes at least one guard clearance system. The clearance system comprises a movable arc of lower guard ring displaceably coupled to an end of the cage and a pair of buffer wheels mounted to the cage. When the arc is retracted an unguarded segment of rotor sweep is established. The buffer wheels are adapted to contact a wall. The trowel can move along the wall finishing the slab at the wall base.

Expansion of my trowel allows one to fit pans on the blades. First, the cage is expanded by loosening the allen screws in the bosses to spread the cage and inserting the cage spacers. Then the tertiary torque shaft is removed, and the bolts mounting the tertiary linkage support brace are loosened. The allen screws retaining the blocks are loosened, and the engines, gearboxes and rotors move outwardly, extending the driveshaft and torque rods. A torque shaft of the appropriate length is installed, and the screws and bolts retightened. The sides of the trowel are lifted and the pans placed under the blades. The blades are rotated to index with the pan tabs.

The steps to narrow the trowel begin with removing the pans. Then the longer torque shaft is removed and the tertiary support brace bolts loosened. The sliding block allen screws are loosened, and the engines, gearboxes and rotors move inwardly to retract the torque rods and driveshaft. The shorter, tertiary torque shaft is installed and the bolts and screws retightened. Finally, the cage spacers are removed and the cage moves inwardly.

Therefore, it is a primary object of my Variable Width, Twin Engine Riding Trowel to provide a single trowel to serve as both a blade finisher and a panning machine.

An object of the present invention is to provide a variable width trowel that is capable of quick adjustment.

A related object is to provide a variable width trowel that allows conversion on the job site for panning and blading operations.

Another important object is to provide a panning trowel that allows surface finishing to proceed at an earlier stage of concrete placement.

A related object is to provide a floating disc or panning trowel that allows wet concrete to be worked earlier An object of the present invention is to provide a trowel employing pans having a relatively greater overall diameter, lowering machine bearing pressure on freshly placed concrete.

A further related object is to provide a trowel that will promote a hydraulic effect upon the concrete monolith.

An object of the present invention is to provide a trowel that is capable of obtaining superior overall smoothness in finished concrete floors.

An object of the present invention is to provide a riding trowel that increases production.

A related object is to provide a riding trowel that is particularly well suited for use on quick curing concrete jobs.

An object of the present invention is to provide a panning trowel particularly well suited for use with high slump concrete.

An object of the present invention is to provide a trowel well suited for use on confined job sites.

An object of the present invention is to provide a variable width trowel capable of adjustment by one worker.

An object of the present invention is to provide a single trowel capable of producing super-flat floor finishes.

An object of the present invention is to provide a riding trowel that is capable of finishing concrete immediately adjacent obstacles.

Another object of the present invention is to provide a trowel that will maintain a spaced apart relationship with a wall while allowing finishing of the slab immediately adjacent the wall.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
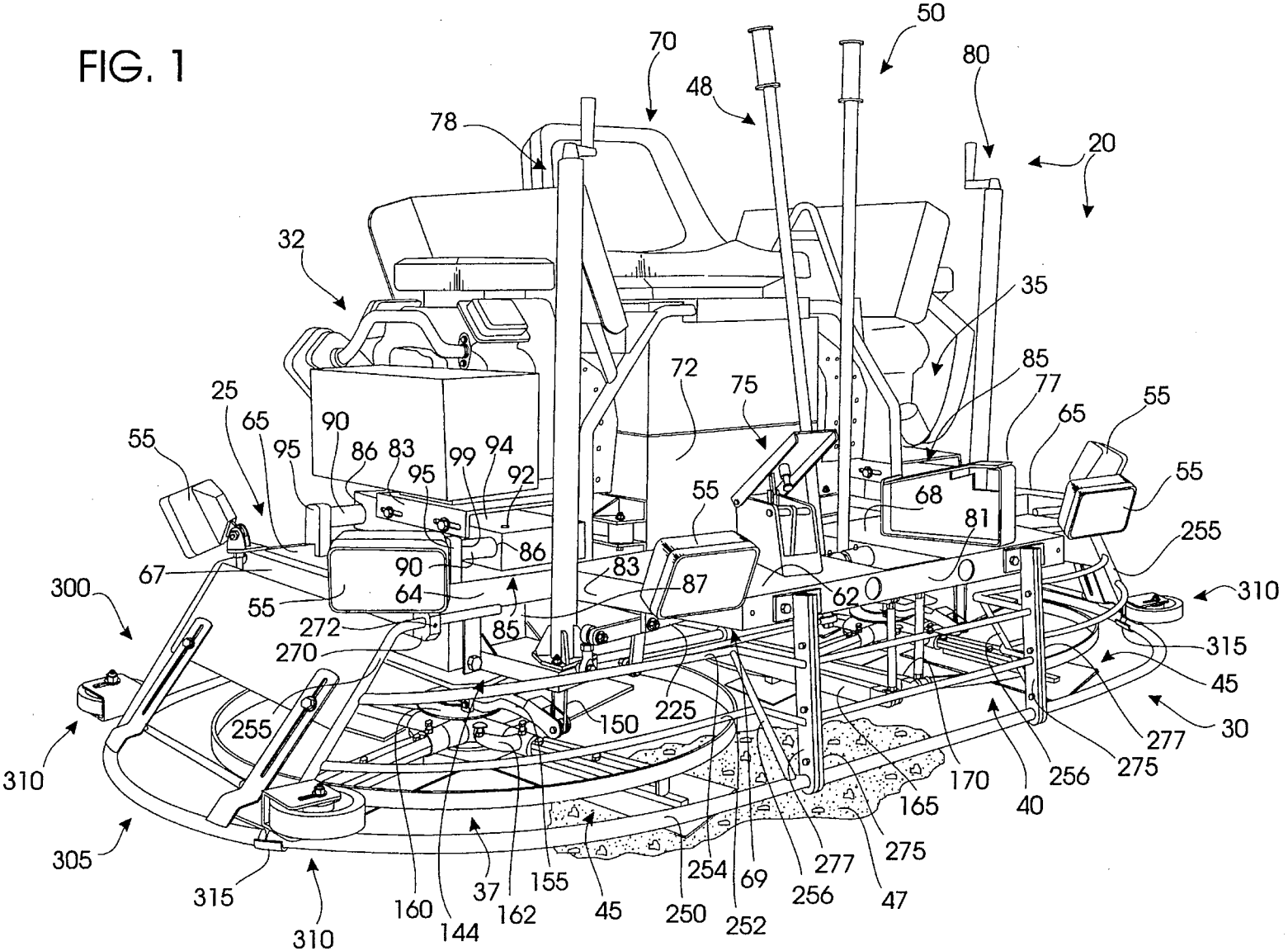
FIG. 1 is a front, environmental, isometric view of my Variable Width, Twin Engine Riding Trowel in the narrow configuration.
Figure 2:
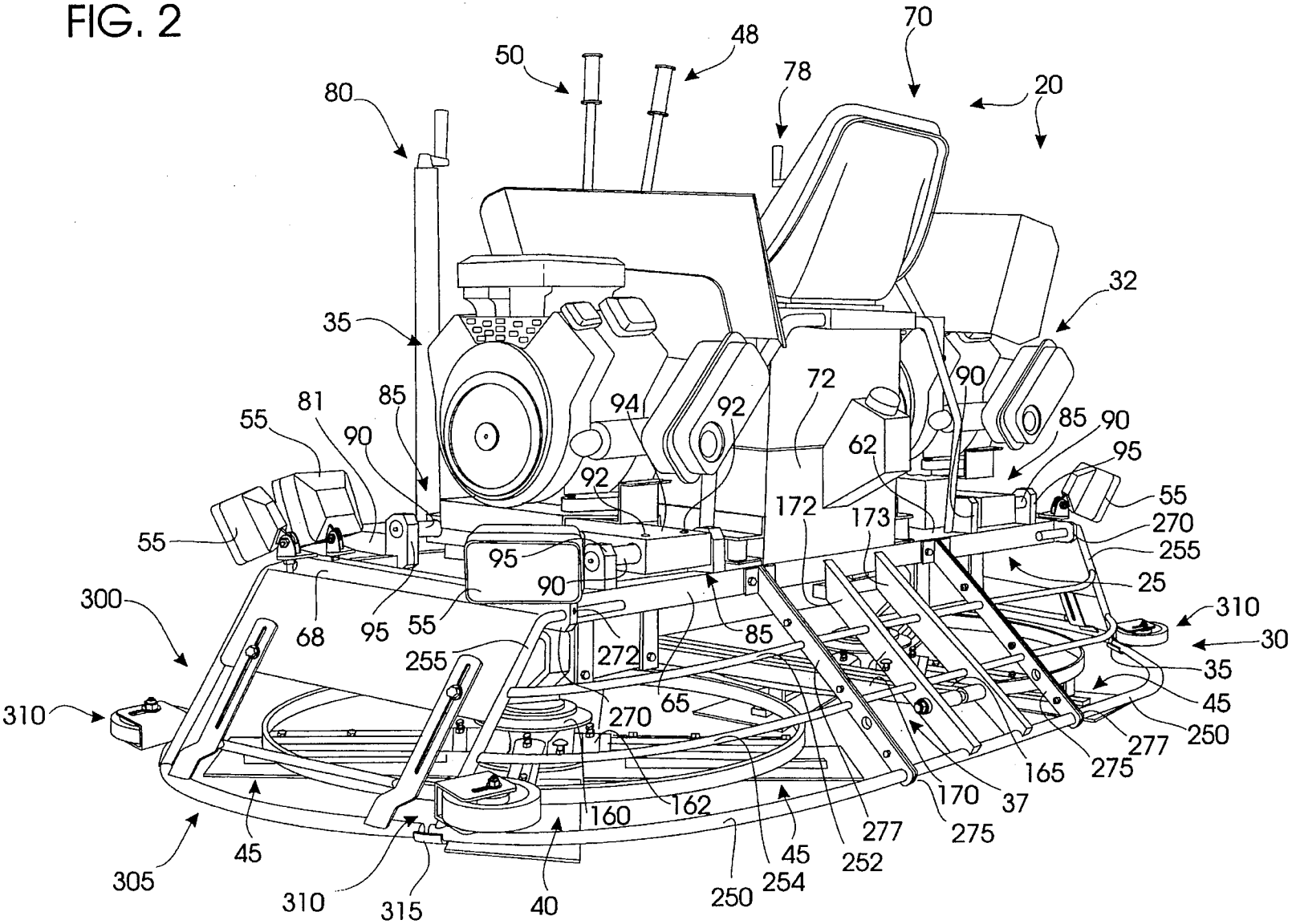
FIG. 2 is a rear, environmental, isometric view of my trowel.
Figure 3:
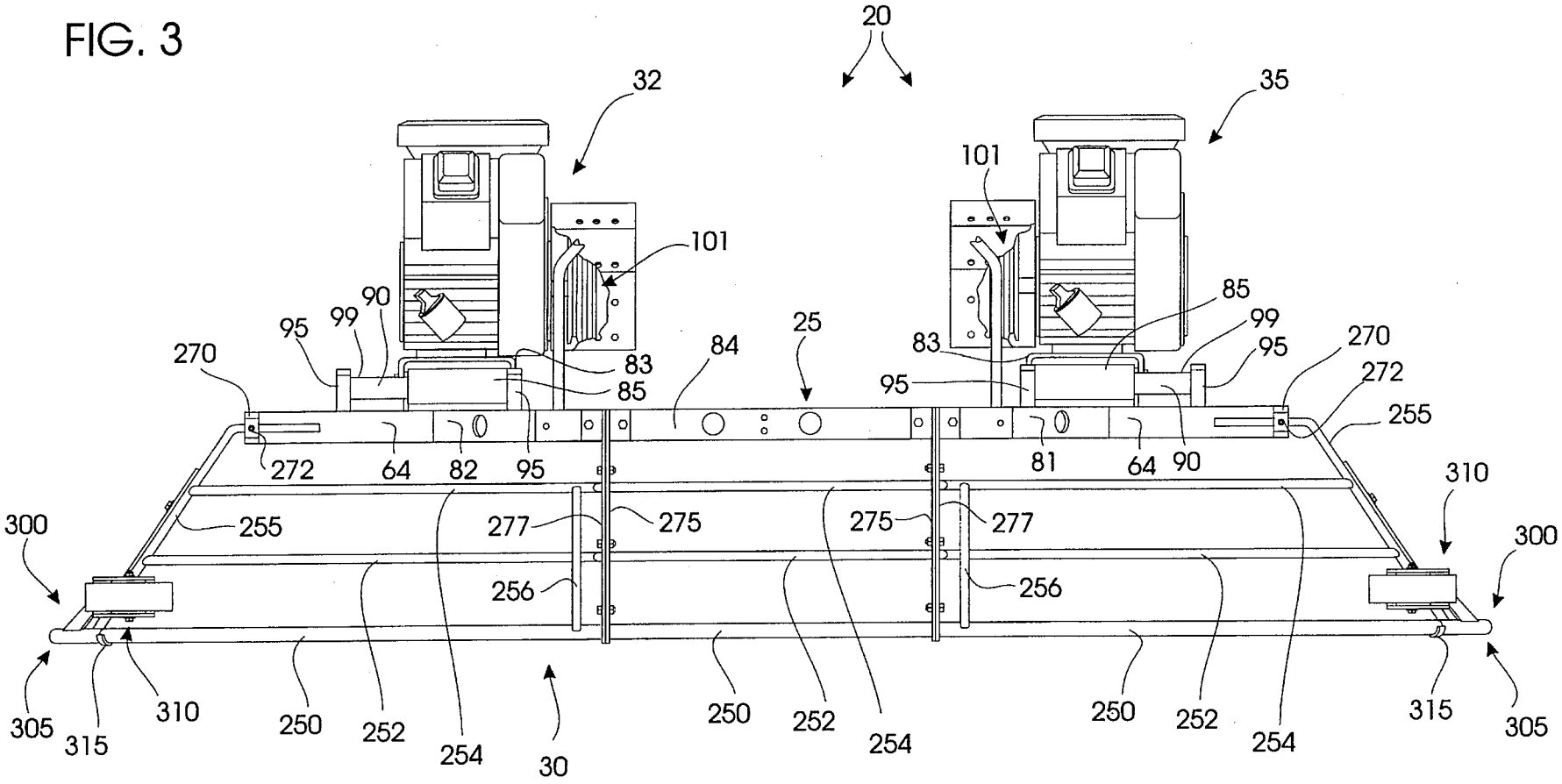
FIG. 3 is a front, fragmentary, elevational view of my trowel in the narrow configuration, illustrating the cage, with portions omitted for clarity.
Figure 4:
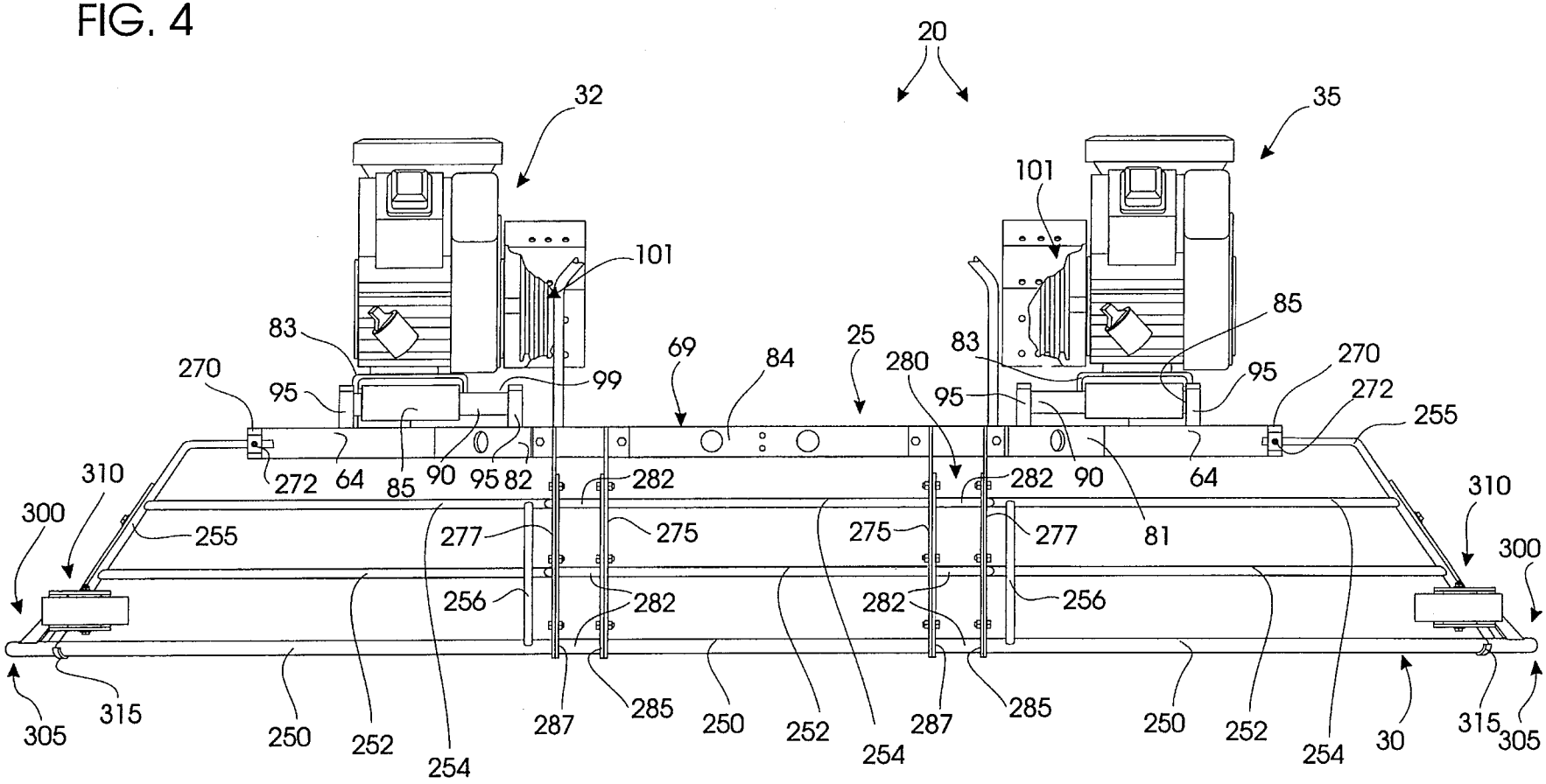
FIG. 4 is a front fragmentary elevational view of my trowel in the wide configuration, illustrating the inserted cage spacers.
Figure 5:
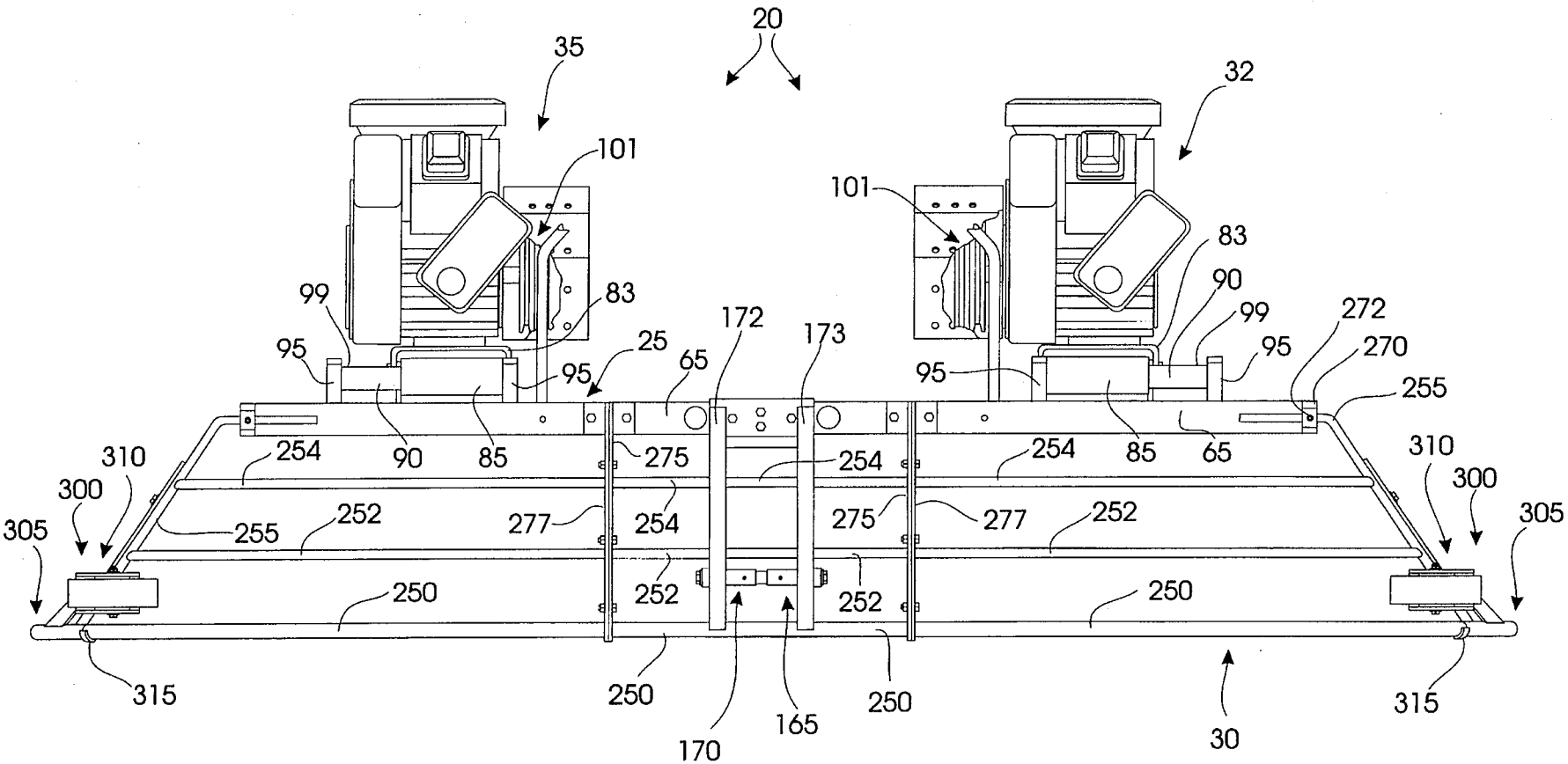
FIG. 5 is a rear fragmentary elevational view of my trowel in the narrow configuration, illustrating the cage.
Figure 6:
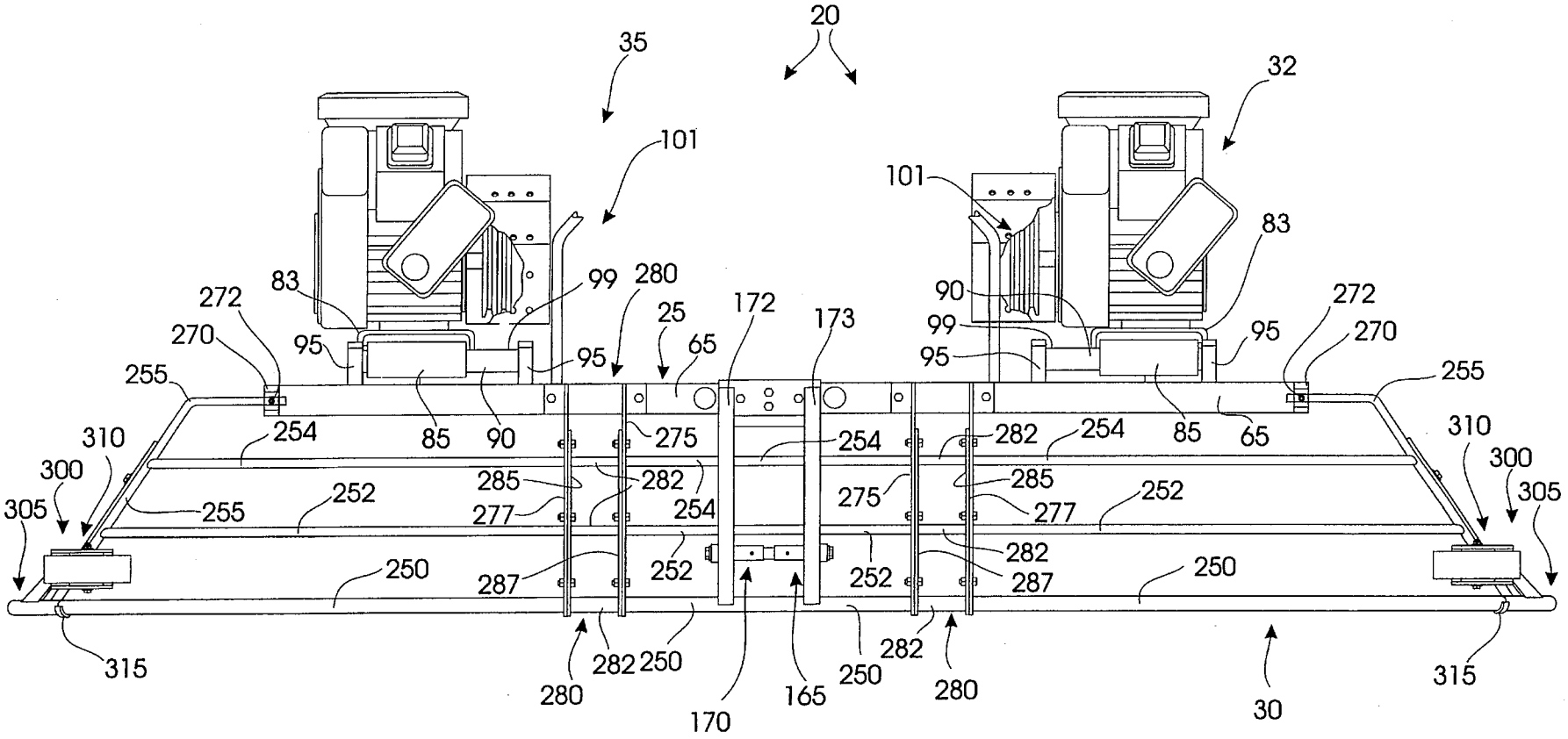
FIG. 6 is a rear fragmentary elevational view of my trowel in the wide configuration, illustrating the inserted cage spacers.

With attention now directed to the accompanying drawings, my Variable Width, Twin Engine Riding Trowel is broadly designated by the reference numeral 20. My riding trowel 20 comprises a metal frame 25, surrounded by a guard cage 30. The frame 25 mounts a pair of displaceable motors 32, 35 that drive a pair of counter-rotating, synchronized bladed rotors 37, 40 via drive gear assemblies. The rotor blades 45 frictionally contact the concrete surface 47 to be finished and support the weight of the trowel 20 and operator. As viewed by the seated operator, the right rotor 37 revolves in a clockwise direction, and the left rotor 40 revolves counterclockwise. The operator manually steers with a pair of primary control levers 48, 50 that tilt the rotors 37, 40 to generate steering forces. The longitudinal pitch of each rotor blade 45 is controlled manually or electrically. Lights 55 attached to frame corners provide illumination when necessary. The trowel 20 may be expanded in width to accommodated a set of finishing pans 60. The pans 60 are mounted directly on the blades 45 of the rotors 37, 40.

The frame 25 comprises an upper deck 62 supported by front and rear frame members 64, 65 and ends 67, 68 extending between the front and rear members 64, 65. A seat 70 and controls are mounted to the frame 25. A gas tank 72 is disposed beneath the seat 70. Engine controls are mounted in panels beside the seat (not shown). Tubular handles 78, 80 or electronic controls are employed by the operator to vary the pitch of the rotor blades 45. A forward subframe 69 projects from the frame 25. It mounts a pair of primary control levers 48, 50, a throttle pedal 75, and a foot rest 77. The subframe 69 is comprises of sides 81, 82 angularly extending forwardly from the front frame member 64 and a front cross member 84. The upper deck 62 extends over the subframe 69.

Each motor 32, 35 is mounted similarly. Therefore, only one will be discussed in detail. The motors 32, 35 are preferably horizontal shaft internal combustion engines 32, 35. Each engine 32, 35 is mounted to a motor mount 83 which in turn is secured to a top plate 87 of a gearbox 105, 110. Bolts 83A pass through slots 83C in the motor mount 83 and orifices 87A in the top plate 87 and are secured by nuts 83B. The top plate 87 is secured to the gearbox by bolts 87B passing through orifices 87C defined in the plate 87. The gearbox plate 87 is pivotally secured to a generally parallelepiped sliding block 85.

Figure 7:
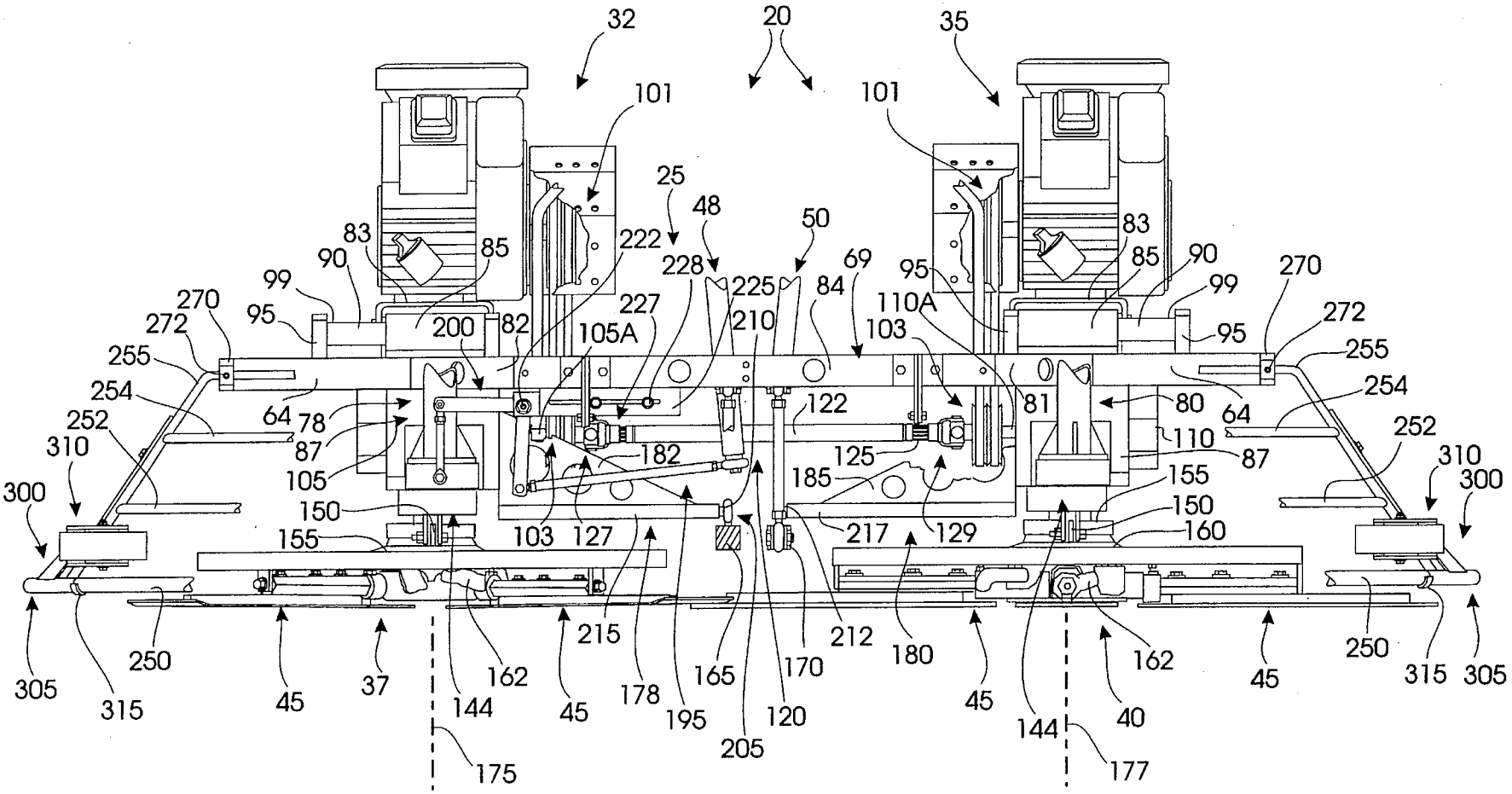
FIG. 7 is a front fragmentary elevational view of my trowel in the narrow configuration, illustrating the spatial relationship of the motor and rotor assemblies and the steering components, with portions omitted and broken away for clarity.
Figure 8:
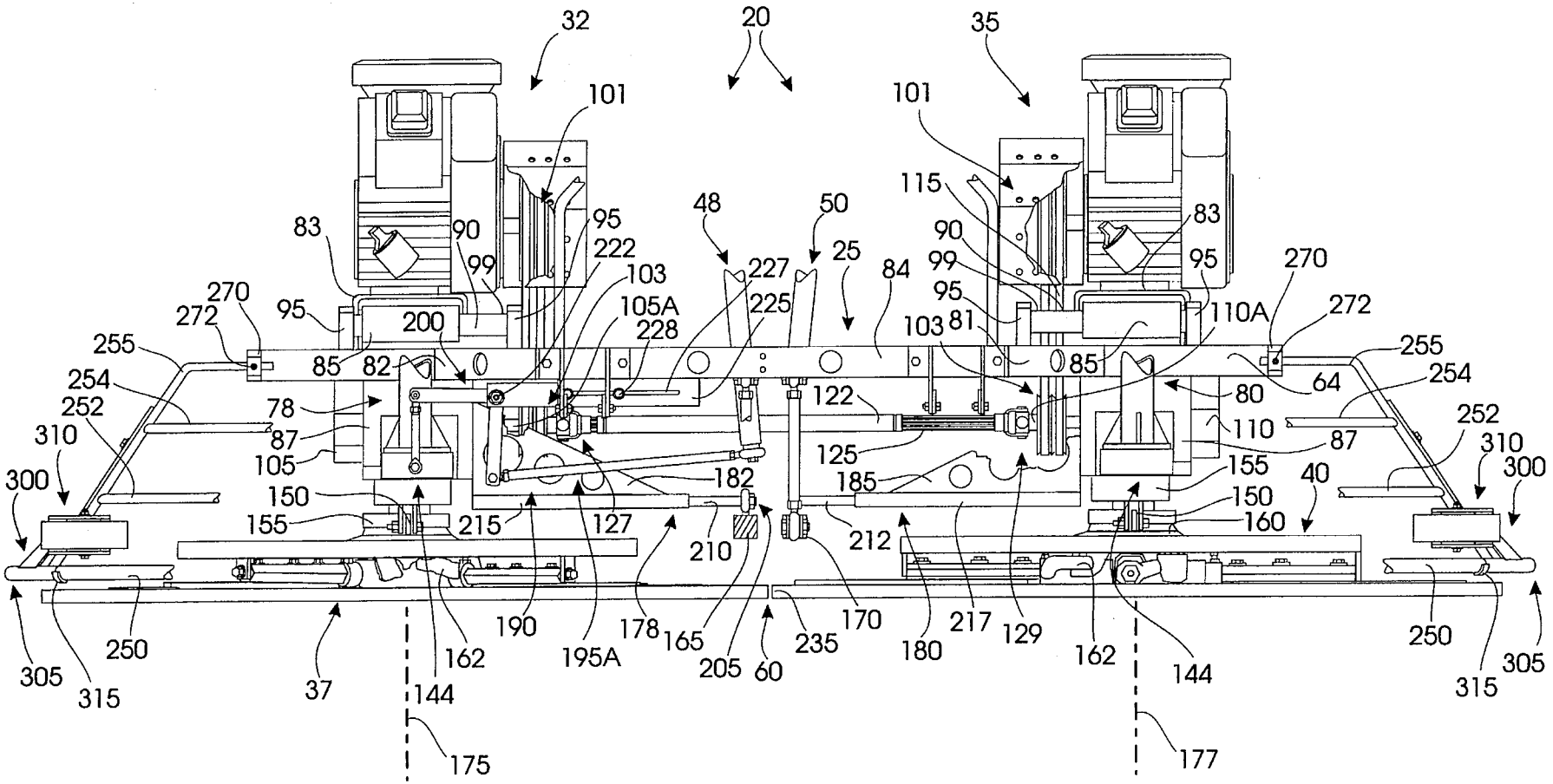
FIG. 8 is a front fragmentary elevational view of my trowel in the wide configuration, with finishing pans installed, illustrating displacement of the aforementioned components.
Figure 12:
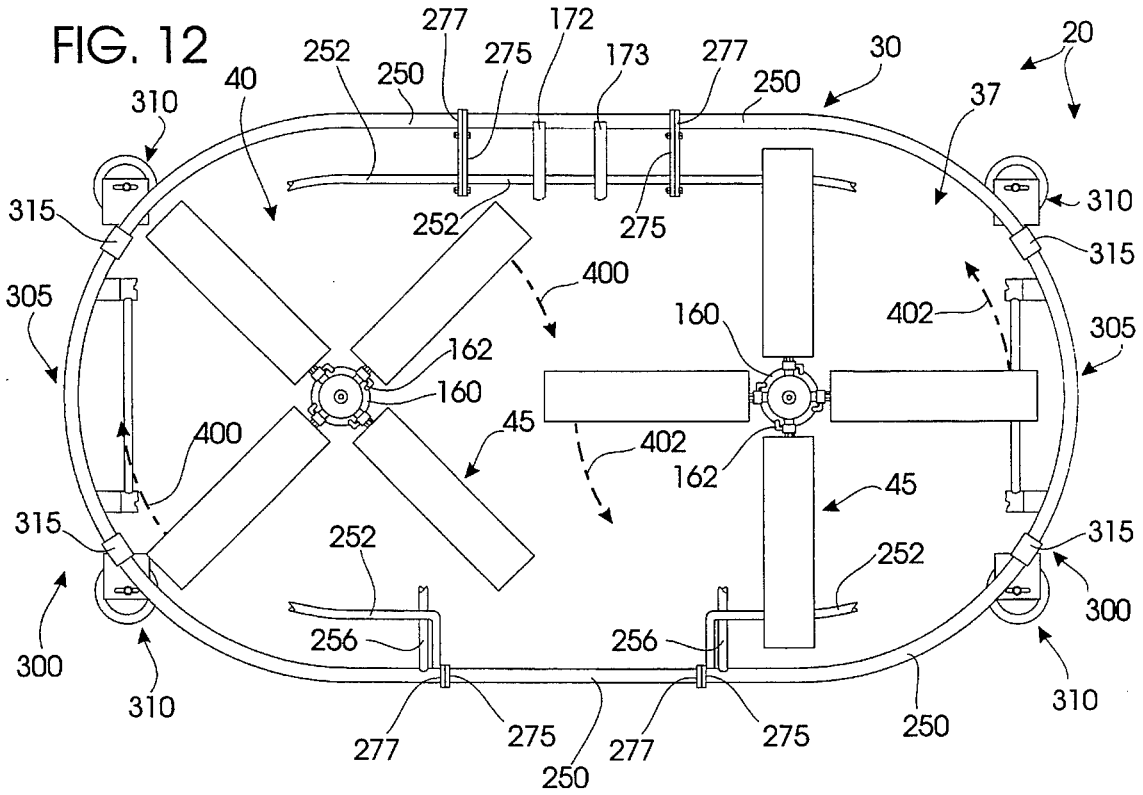
FIG. 12 is a fragmentary, bottom plan view of my trowel in the narrow configuration, illustrating the overlap between sweeps of the rotors, with portions omitted for clarity; and, FIG. 13 is a fragmentary, bottom plan view of my trowel in the wide configuration, illustrating disposition of pans on the blades, with the blades and pan tabs illustrated in hidden, dashed lines.

Sub-frame blocks 85 function as movable sub-frames to enable the position of the motor-rotor assemblies to be varied, when the unit is contracted or retracted. Each block 85 defines two passageways 86 to receive a pair of rails 90 associated with the frame 25. Allen screws 92 are threaded through orifices 92A in the upper surface 94 of the blocks 85 to engage the rails 90. Each rail 90 is spaced apart from, and secured to, the frame 25 by a pair of brackets 95. Preferably, the rails 90 are cylindrical, defining flats 99 near each bracket 95. The allen screws 92 contact these flats 99, maintaining the block 85 in the desired position. The output shaft of the motor 32, 35 drives a clutch controlling a pulley 101 (FIG. 7) which is connected to an input shaft pulley 103 of a gearbox 105, 110 by fan belts 115. These belts can slip to prevent motor damage. An extensible driveshaft 120 interconnects the input shafts 105A, 110A of the gearboxes 105, 110. The driveshaft 120 mechanically synchronizes the rotors to prevent the overlapping rotor blades (FIG. 12) from contacting each other. Extensible driveshaft 120 comprises an outer housing 122 mated to a splined inner shaft 125 (FIG. 8). U-joints 127, 129 on each end of the driveshaft 120 allows independent movement of the gearboxes 105, 110.

Figure 9:
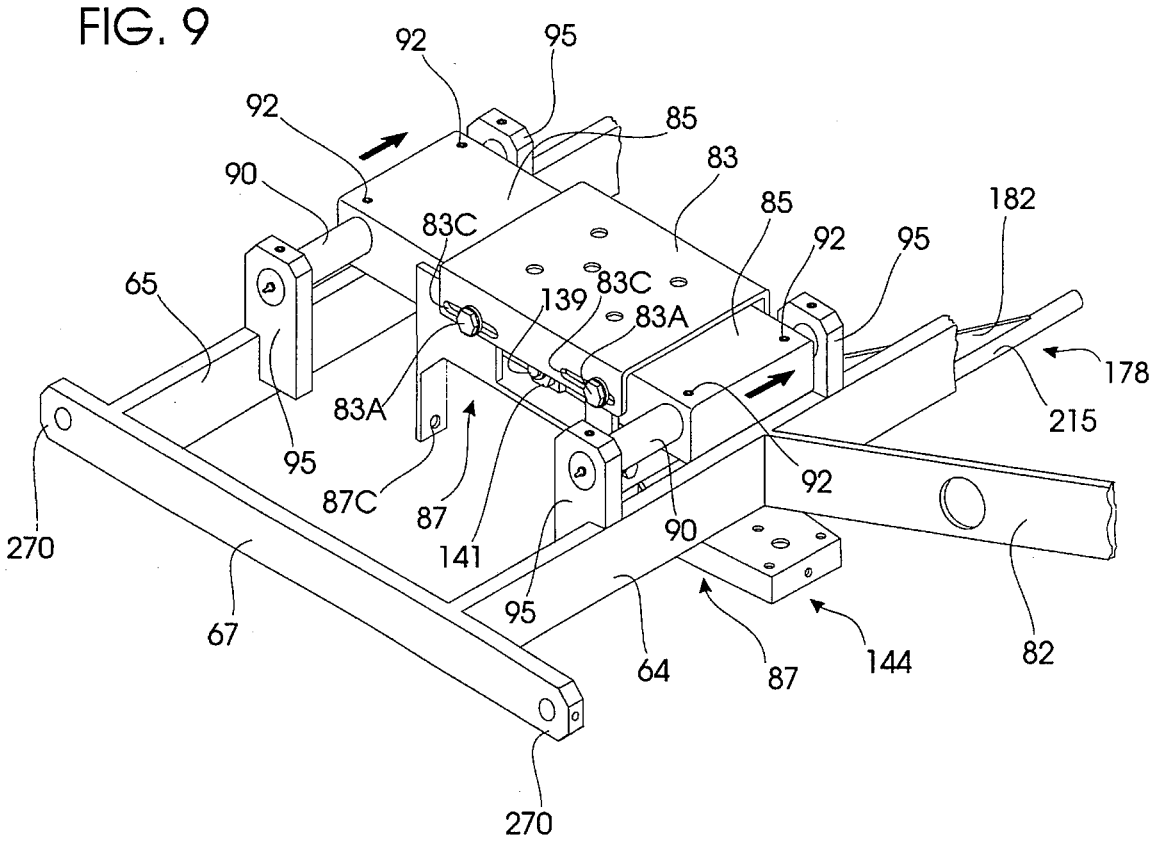
FIG. 9 is a front fragmentary isometric view, with portions omitted for clarity, showing the position of the sliding block to the driver's right in the narrowed configuration.
Figure 10:
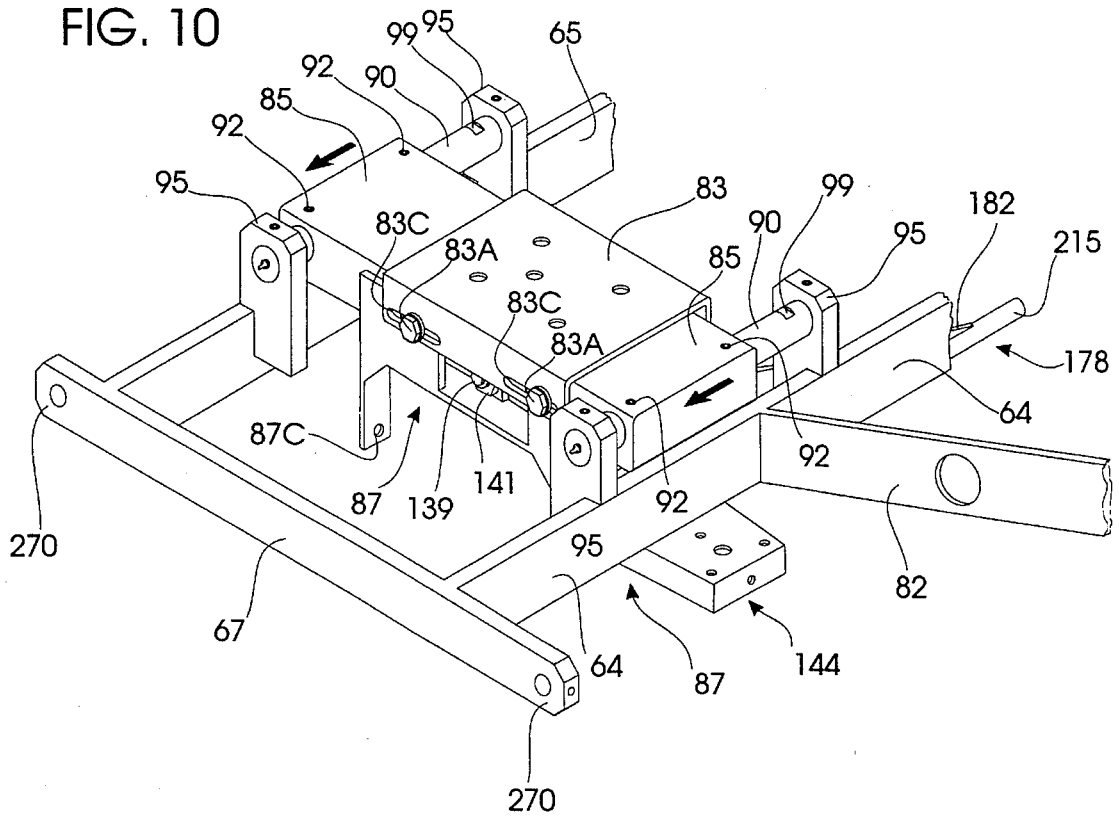
FIG. 10 is a front fragmentary isometric view, with portions omitted for clarity, showing the position of the sliding block of FIG. 9 in the wide configuration.
Figure 11:
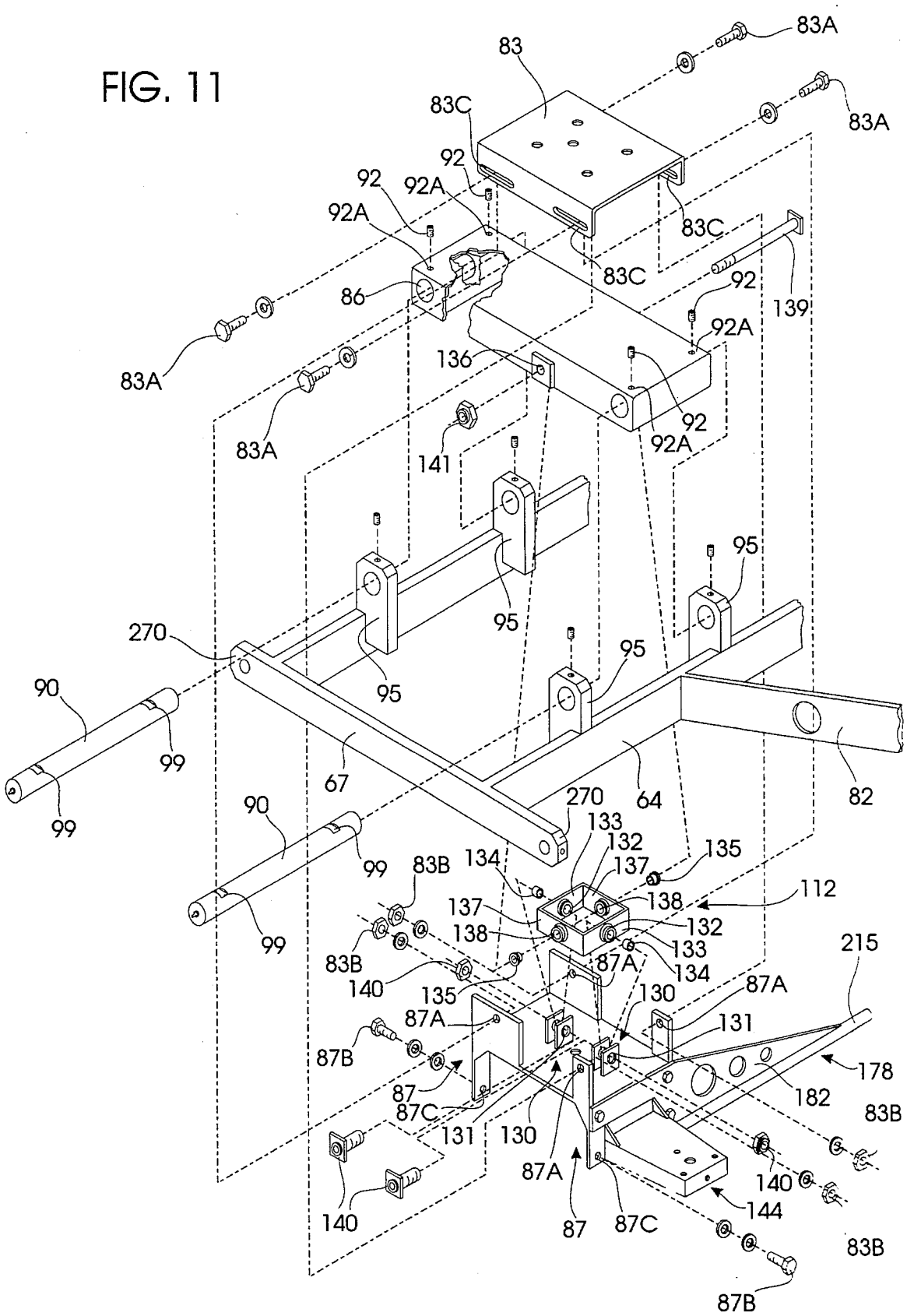
FIG. 11 is an exploded front fragmentary isometric view, with portions omitted for clarity, showing the components related to mounting an engine and gearbox to the sliding block, and steering parts.

As discussed in greater detail in U.S. Pat. No. 5,108,220, the disclosure of which is hereby incorporated by reference, each gearbox 105, 110 is pivotally mounted to a tiltable, pivotable steering crosshead box 112. In the present invention, the steering crosshead boxes 112 secure the gearbox top plates 87 to the sliding block 85. Therefore, when a block 85 slides along the rails 90, both the motor 32, 35 and the gearbox 105, 110 move with it. How a gearbox tilts is established by connection of its pivot steering crosshead box 112 to the sliding block 85 (FIGS. 9 through 11). Each gear box 105, 110 is mounted to the underside of a sliding block 85 by a tiltable, pivot steering box 112.

Pivot steering box 112 allows its gearbox 105 to tilt right to left and front to back, whereas the opposite steering box allows gearbox 110 to tilt only right and left. The pivot steering boxes 112 are structurally identical. They are mounted differently for steering purposes. The mounting system for the crosshead steering box 112 is illustrated in FIG. 11.

The crosshead pivot steering boxes 112 are generally square. Bearing mandrels, defining orifices 132, 138 are formed in the front, back and sides 133, 137 of the crosshead boxes 112. The top plate 87 of the gearbox 105 includes twin pairs of upwardly rising nubs 130 having aligned orifices 131 adapted to register with bearing orifice 132 on the front and back 133 of the pivot steering box 112. Bearings 134 are captivated between the nubs 130 within the bearing orifices 132. A reinforced bearing 135 fits between reinforced orifices 136 defined in the sides of the sliding block 85 and sides 137 of the steering box 112, extending into orifices 138 in the sides 137 of the pivot steering box 112. Bolts 139 and 140 are fitted through the nubs 130, reinforced block orifices 136 and box orifices 132 and 138 as shown in FIG. 11 to suspend pivot steering box 112 for pivotal movement. Each bolt 139, 140 is retained by a self locking nut 141. Pivoting about bolt 139 results in gearbox movement in a forward and back arc. Pivoting about bolts 140 results in gearbox movement in an arc from side to side.

The pivot steering box on the opposite side is mounted exactly as described above with the addition of a pair of bolts passing through each side of the sliding block 85. These bolts are threaded into orifices in the sides of the steering box. These bolts prevent rotation about the pivot bolt 139, thereby allowing this gearbox 110 to only pivot from side to side.

The bladed rotor 37, 40 is secured to a shaft extending downwardly from the gearbox 105, 110 as disclosed in grater detail in the aforementioned patent. Tubular handle assemblies 78, 80 or electric linear actuators, controlled by the operator are employed to vary the pitch of the rotor blades 45. These assemblies 78, 80 are mounted on a ledge 144 extending from the associated gearbox top plate 87. The assemblies 78, 80 each control a cable 150 extending to a pivoting fork 155 which contacts and actuates a swash plate 160. The swash plate 160 contacts an arm 162 extending from each blade 45, deflecting the blade 45 to the desired pitch.

The steering system for the present trowel 20 is disclosed in detail in the above referenced patent. Generally, parallel lever arms 165, 170 extend beneath the frame 25 in a direction generally perpendicular to the biaxial plane defined by the rotor axes 175, 177. The arms 165, 170 are pivotally anchored to inclined struts 172, 173 extending from the rear frame member 65. The arms 165, 170 may be deflected by the primary control levers 48, 50. Each arm 165, 170 activates elongated torque rods 178, 180 coupled to the gearboxes 105, 110 and tilt the rotors 37, 40 in a plane parallel with the biaxial plane. The torque rods 178, 180 are generally aligned and extend along the bottom of gussets 182, 185 projecting from the gearbox housings 105, 110. The rods 178, 180 are also offset from the axis of rotation defined within the steering boxes as disclosed in the above referenced patent. The right rotor 37 also tilts in an arc perpendicular to the biaxial plane. The right control lever 48 controls a tertiary linkage 190 comprising a torque shaft 195 or 195A interconnected with a "C" shaped crank 200 that tilts this rotor 37 in a plane perpendicular to the biaxial plane.

However, the steering linkage is modified in the present invention to accommodate the variable width innovation. The torque rods 178, 180 are extensible. The ball and socket joints 205 secured to the mid portion of the lever arms 165, 170 are secured to inner shafts 210, 212. The inner shafts 210, 212 sleeve within a hollow housing 215, 217 of the torque rod 178, 180 and are secured along the base of the gusset 182, 185. The tertiary linkage 190 extending from the primary control lever 48 to the biaxially deflectable rotor 37 must also be adjusted when the trowel width is varied. A support brace 220 for the mandrel 222, which provides a pivot point for the "C" shaped crank 200, is slidably coupled to a slotted bracket 225 secured to the frame 25. This bracket 225 provides a longitudinal slot 227 through which bolts 228 pass into the brace 220. The bolts 228 may be loosened to move the brace 220 outwardly and inwardly. This allows a torque shaft 195A of the appropriate length to be inserted between the end of the primary lever 48 and the crank 200.

Figure 13:
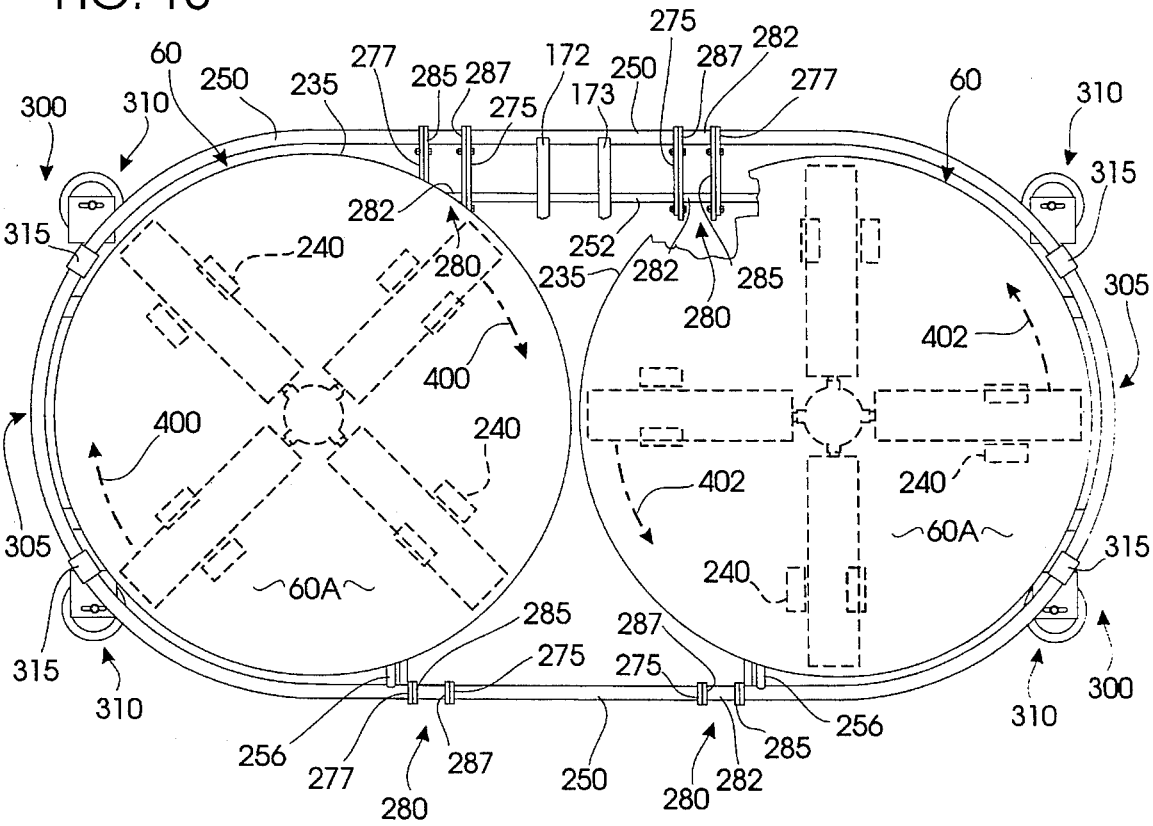

The pans 60 are generally disc shaped finishing implements with an upturned, rimmed circumference 235 (FIG. 13). They are provided with tabs 240 disposed on the inner surface. The tabs are bent to define a narrow offset. The blades 45 of the trowel 20 wedgably index with the offset. The large flat surface area 60A of the pans 60 is used to provide a super-smooth and super-flat floor finish.

The guard cage 30 comprises a lower oval ring 250 that is offset from the concrete surface 47. Reinforcement, guard bars 252, 254 are spaced apart and above the lower ring 250. Radially spaced apart reinforcement spokes 255, 256 extend between the ring 250, bars 252, 254 and frame deck 62. The end spokes 255 are coupled to the frame 25 by bosses 270 disposed on the ends 67, 68 of the frame 25. These bosses 270 define orifices to receive the end spokes 255. Threaded holes in the bosses 270, perpendicular to the spoke receptive orifices, receive allen screws 272 to retain the spokes 255 in place. The cage 30 further comprises separable flanges 275, 277. The flanges 275, 277 are bolted together whenever the trowel cage 30 is narrowed and unbolted when expanded. Spacers 280 are inserted between the flanges 275, 277 when the trowel 20 is expanded. The spacers 280 comprise straight lengths of cage bar material 282 secured between perpendicular flanges 285, 287. When the trowel 20 is expanded a spacer 280 is inserted between the cage flanges 275, 277. The spacer flanges 285, 287 are aligned with the cage flanges 275, 277 and bolted in place.

Preferably, the present invention employs at least one guard clearance system 300. This system 300 comprises a movable arc 305 of lower guard ring 250 displaceably coupled to an end of the cage 30 and spaced apart buffer wheels 310 mounted to the cage 30. The arc 305 is displaceable between a deployed position generally aligned with the lower ring 250 and a retracted position. When retracted, an unguarded segment of rotor sweep is established that allows the finishing blades 45 or pan 60 to be deployed immediately adjacent a wall or other obstacle. The buffer wheels 310 contact the wall, allowing forward and rearward movement of the trowel 20 along the wall while finishing the slab 47 immediately adjacent the wall. Semicylindrical cradles 315 extend from the cage 30 to support with the arc 305 when it is deployed.

Operation

I. Expansion

In operation the present trowel 20 mechanically expands to accept pans 60 to provide a super-flat finish to a slab or floor 47. To expand the trowel 20, the cage flanges 275, 277 are unbolted; the allen screws 272 in the cage bosses 270 are loosened; and the cage 30 is moved outwardly. The allen screws 272 are then retightened, the cage spacers 280 are inserted between the cage flanges 275, 277 and bolted into place.

The torque shaft 195 is removed from the end of the primary steering lever 48 and/or the "C" shaped crank 200. The bolts 228 mounting the crank mandrel 222 support brace 220 to the slotted bracket 225 are loosened.

The allen retaining screws 92 in the blocks 85 mounting the engines 32, 35 and gearboxes 105, 110 are loosened and the sliding blocks 85 are slid outwardly. As the engines 32, 35 and gearboxes 105, 110 move outwardly, the torque rods 178, 180 extend and the driveshaft 120 extends along its splines. The allen screws 92 in the blocks 85 are aligned with the outer flats 99 in the rails 90. The allen screws 92 are retightened to retain the engines 32, 35 and gearboxes 105, 110 in the extended position.

A torque shaft 195A of the appropriate length is inserted between the end of the primary lever 48 and the crank 200. The bolts 228 passing through the slotted bracket 225 are retightened.

Finally, the pans 60 are fitted in place by lifting each end of the trowel 20 and inserting the pans 60 underneath the blades 45. The blades 45 are rotated to contact the tab offsets and wedged into place.

II. Retraction

The bladed rotors 37, 40 are used to provide a super-smooth finish to the floor 47. To restore the trowel 20 to the narrowed configuration the pans 60 are removed first. Then the longer torque shaft 195A is removed from the end of the primary steering lever 48 and/or the "C" shaped link. The bolts 228 passing through the slotted bracket 225 securing the crank mandrel support brace 220 are loosened.

The allen retaining screws 92 in the blocks 85 are loosened and the engines 32, 35 and gearboxes 105, 110 move inwardly retracting the torque rods 178, 180 and driveshaft 120. The allen screws 92 in the blocks 85 are aligned with the inner flats 99 defined in the rails 90 and retightened, securing the engines 32, 35 and gearboxes 105, 110 in the retracted position.

The shorter torque shaft 195 is inserted between the end of the primary lever 48 and the crank 200. The bolts 228 mounting the crank mandrel support brace 220 are retightened.

Finally, the cage 30 is narrowed. The cage spacers 280 are unbolted and removed. The allen screws 272 in the cage bosses 270 are loosened and the cage 30 is moved inwardly. The allen screws 272 are then retightened and the cage flanges 275, 277 bolted together.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A motorized riding trowel for finishing a concrete surface, said riding trowel comprising:

a frame;

motor means depending from said frame for powering said riding trowel;

two rotor means driven by said motor means and depending downwardly from said frame for frictionally contacting said concrete surface and supporting said frame thereabove, each rotor means establishing a generally vertical axis of rotation; and, means for enabling the distance between the axis of rotation of each rotor means to be expanded or contracted.

2. The riding trowel as defined in claim 1 wherein said motor means comprises a pair of internal combustion engines, one engine controlling each rotor means.

3. The riding trowel as defined in claim 2 further comprising:

displaceable motor mount means for adjustably mounting said motor means to said frame means; and, rail means for slidably coupling said motor mount means to said frame means.

4. A self-propelled, variable width motorized riding trowel for finishing a concrete surface, said riding trowel comprising:

motor means for powering said riding trowel;

seat means for supporting an operator of said riding trowel;

control means accessible by said operator from said seat means for steering and controlling said riding trowel;

frame means adapted to be disposed over said concrete surface for supporting said seat means, said control means and said motor means;

two displaceable rotor means driven by said motor means and associated with said frame means for frictionally contacting said concrete surface and supporting said frame means thereabove, each rotor means establishing a generally vertical axis of rotation; and, means for enabling the distance between the axis of rotation of each rotor means to be expanded or contracted.

5. The riding trowel as defined in claim 4 wherein said motor means comprises a pair of internal combustion engines, one engine controlling each rotor means.

6. The riding trowel as defined in claim 4 including extensible guard cage means/for preventing inadvertent contact between said rotor means and foreign objects, said guard cage means mounted on said frame means.

7. The riding trowel as defined in claim 5 further comprising:

displaceable motor mount means for adjustably mounting said motor means to said frame means; and, rail means for slidably coupling said motor mount means to said frame means.

8. The riding trowel as defined in claim 5 wherein said control means comprises a telescoping shaft extending between said motors, said shaft assuming a length dependent upon the distance between the axes of rotation of said rotor means.

9. The riding trowel as defined in claim 6 further comprising finishing pans adapted to be removably mounted to said blades for contacting and flattening a surface to be finished.

10. A self-propelled, dual motor, variable width riding trowel for finishing a concrete surface, said riding trowel comprising:

a pair of displaceable motors for powering said trowel;

frame means adapted to be disposed over said concrete surface for mounting said motors;

displaceable rotor means associated with said frame means for frictionally contacting said concrete surface and supporting said frame means thereabove;

drive means associated with each of said motors for revolving said rotor means in response to said motors, said drive means establishing spaced apart generally vertical axes of rotation for said rotor means;

extensible means disposed beneath said frame means for tilting said rotor means in response to said control means for steering;

extensible guard cage means for preventing inadvertent contact between said rotor means and foreign objects, said guard cage means mounted on said frame; and, displacement means for varying the distance between said axes of rotation.

11. The riding trowel as defined in claim 10 wherein said rotors are synchronized by a telescoping shaft extending between the rotors.

12. The riding trowel as defined in claim 10 further comprising:

displaceable motor mount means for adjustably mounting said motors to said frame means;

rail means for slidably coupling said motor mount means to said frame means.

13. The riding trowel as defined in claim 12 wherein said control means comprises a replaceable torque shaft, said shaft having a length dependent on the distance between said axes.

14. The riding trowel as defined in claim 13 further comprising finishing pans adapted to be removably mounted to said blades for contacting and flattening a surface to be finished, said pans comprising offset tabs to wedgably receive said blades.

15. A self-propelled, dual motor riding trowel for finishing a concrete surface, said riding trowel comprising:

a rigid frame adapted to be disposed over said concrete surface;

seat means on said frame for supporting an operator of said riding trowel;

a pair of spaced apart, rotors projecting downwardly from said frame for frictionally contacting said concrete surface and supporting said frame thereabove, each rotor establishing a generally vertical axis of rotation;

a motor associated with each of said rotors for powering said riding trowel;

displaceable motor mount means for adjustably mounting each of said motors and their associated rotors to said frame, said displaceable motor mount means comprises a sliding subframe block for supporting the motor and rail means extending from the frame penetrating the block for slidably coupling said motor mount means to said frame;

control means accessible by said operator from said seat means for steering and controlling said riding trowel; and, means for synchronizing said motors.

16. The riding trowel as defined in claim 15 wherein said synchronizing means comprises a replaceable shaft, said shaft having a length dependent upon the distance between the axes of rotation of said rotors.

17. A self-propelled, dual motor riding trowel for finishing a concrete surface, said riding trowel comprising:

a rigid frame adapted to be disposed over said concrete surface;

seat means on said frame for supporting an operator of said riding trowel;

a pair of spaced apart, rotors projecting downwardly from said frame for frictionally contacting said concrete surface and supporting said frame thereabove, each rotor establishing a generally vertical axis of rotation;

a motor associated with each of said rotors for powering said riding trowel;

control means accessible by said operator from said seat means for steering and controlling said riding trowel; and, means comprising a replaceable shaft for synchronizing said motors, said shaft having a length dependent upon the distance between the axes of rotation of said rotors.

18. A self-propelled, dual motor riding trowel for finishing a concrete surface, said riding trowel comprising:

a rigid frame adapted to be disposed over said concrete surface;

seat means on said frame for supporting an operator of said riding trowel;

a pair of spaced apart, rotors projecting downwardly from said frame for frictionally contacting said concrete surface and supporting said frame thereabove, each rotor establishing a generally vertical axis of rotation;

a motor associated with each of said rotors for powering said riding trowel;

control means accessible by said operator from said seat means for steering and controlling said riding trowel; and, means comprising a shaft extending from an output of a first motor to an output of a second motor for synchronizing said motors.

19. A self-propelled dual motor riding trowel for finishing a concrete surface, said riding trowel comprising:

a rigid frame adapted to be disposed over said concrete surface, said frame comprising a front, a rear, and a pair of spaced apart ends;

seat means on said frame for supporting an operator of said riding trowel;

a pair of spaced apart rotors projecting downwardly from said frame for frictionally contacting said concrete surface and supporting said frame thereabove, each rotor establishing a generally vertical axis of rotation and comprising a plurality of revolving blades that contact and finish concrete, the blades having a longitudinal axis about which they may be rotated to vary their pitch;

a motor disposed upon said frame above each of said rotors for revolving the rotors to finish concrete and propel said riding trowel, each motor establishing a generally horizontal axis of rotation, each axis of motor rotation being substantially collinear with the other;

shaft means for synchronizing said motors, said shaft means extending substantially horizontally between said rotors beneath said seat means and oriented substantially parallel to each axis of rotation;

belt means interconnecting each motor with said shaft means, whereby to power said rotors; and, control means accessible by said operator from said seat means for activating the rotors and said blades to effectuate steering and control of said riding trowel.

20. The riding trowel as defined in claim 19 further comprising displaceable motor mount means for mounting each of said motors, said motor mount means adjustably displaceable towards or away from said front or rear.

21. The riding trowel defined in claim 19 further comprising sliding subframe means for supporting each motor, and rail means extending from the frame penetrating the subframe means for slidably coupling said subframe means to said frame thereby permitting movements of motor position towards or away from said ends.

22. The riding trowel defined in claim 20 further comprising sliding subframe means for supporting each motor, and rail means extending from the frame penetrating the subframe means for slidably coupling said subframe means to said frame thereby permitting movements of motor position towards or away from said ends.

* * * * *